US006705849B2

(12) United States Patent
Zhong et al.

(10) Patent No.: US 6,705,849 B2
(45) Date of Patent: Mar. 16, 2004

(54) DISCHARGE PORTING DESIGN FOR SCREW COMPRESSOR

(75) Inventors: JianPing Zhong, Chesterton, IN (US); William H. Rousseau, Savannah, GA (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/201,175

(22) Filed: Jul. 22, 2002

(65) Prior Publication Data

US 2004/0013555 A1 Jan. 22, 2004

(51) Int. Cl.[7] ..... F04C 18/16
(52) U.S. Cl. ..... 418/201.1
(58) Field of Search ..... 418/201.1

(56) References Cited

U.S. PATENT DOCUMENTS 2,474,653 A * 6/1949 Boestad ..... 418/201.1
2,480,818 A * 8/1949 Whitfield ..... 418/201.1
5,051,077 A * 9/1991 Yanagisawa et al. .... 418/201.1

FOREIGN PATENT DOCUMENTS

JP 54-30520 * 3/1979 ..... 418/201.1

* cited by examiner

*Primary Examiner*—John J. Vrablik
(74) *Attorney, Agent, or Firm*—Bachman & LaPointe

(57) ABSTRACT

A screw compressor including a housing having a discharge port; a plurality of rotors including at least one male rotor and at least one female rotor rotatably disposed in the housing for generating a discharge flow through the discharge port, the discharge port having a radial portion and an axial portion, wherein the discharge port is positioned relative to the plurality of rotors so that the radial portion opens prior to the axial portion whereby kinetic energy in the discharge flow can be recovered.

5 Claims, 6 Drawing Sheets

20 Deg.

0 Deg.

20 Deg.

30 Deg.

DISCHARGE PORTING DESIGN FOR SCREW COMPRESSOR

BACKGROUND OF THE INVENTION

The invention relates to screw compressors and, more particularly, to a discharge porting design of a screw compressor which enhances flow efficiency and provides for recovery of kinetic energy generated in discharge flow from the compressor.

In a conventional compressor having multiple rotors, as the rotors rotate, gas is compressed in rotating pockets. Typically, pressure ratio or volume ratio ($V_I$) is the same for discharge porting in both radial and axial directions. This results in over-compression of some gas, and further results in inefficient operation of the compressor due to dynamic losses and loss of kinetic energy imparted to the gaseous stream, particularly for a high tip speed machine.

It is clear that the need remains for enhanced efficiency in converting kinetic energy generated by the compressor to pressure.

It is therefore the primary object of the present invention to provide improvements in discharge porting for the compressor which recover kinetic energy or dynamic losses as desired.

Other objects and advantages of the present invention will appear hereinbelow.

SUMMARY OF THE INVENTION

In accordance with the present invention, the foregoing objects and advantages have been readily attained.

According to the invention, a screw compressor is provided, which comprises a housing having a discharge port; a plurality of rotors comprising at least one male rotor and at least one female rotor rotatably disposed in said housing for generating a discharge flow through said discharge port, said discharge port having a radial portion and an axial portion, wherein said discharge port is positioned relative to said plurality of rotors so that said radial portion opens prior to said axial portion whereby kinetic energy in said discharge flow can be recovered.

BRIEF DESCRIPTION OF THE DRAWINGS

A detailed description of preferred embodiments of the present invention follows, with reference to the attached drawings, wherein.

DETAILED DESCRIPTION

The invention relates to screw compressors and, more particularly, to screw compressors having enhanced discharge porting features whereby kinetic energy imparted to a discharge flow of compressed gas is at least partially converted to pressure, thereby improving compressor efficiency.

Figure 1:
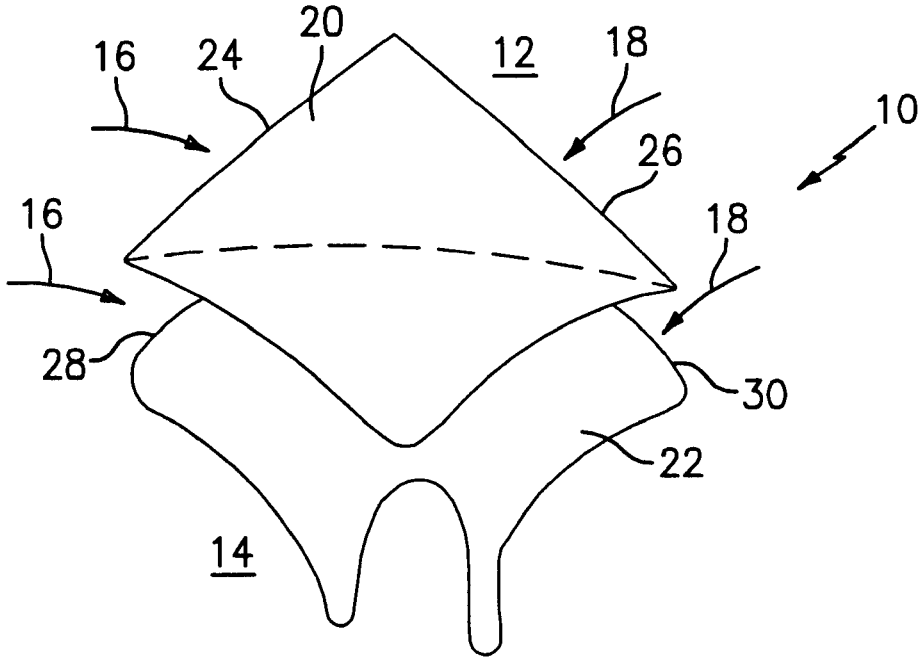
FIG. 1 schematically illustrates enhanced radial and axial discharge porting in accordance with the present invention.

Referring to FIG. 1, discharge porting 10 in accordance with the present invention is further illustrated.

Discharge porting 10 is incorporated into a housing having radial walls 12 and axial walls 14 which define an internal space in which rotatably positioned a plurality of rotors for compressing and discharging gaseous streams. A screw compressor typically includes at least one male rotor schematically illustrated by rotation arrow 16 and at least one female rotor schematically illustrated by rotation arrow 18. FIG. 1 illustrates discharge porting 10 having a radial portion 20 and an axial portion 22. Radial portion 20 is defined by radial porting edges 24, 26 on radial walls 12, and defines a discharge port for radial discharge flow from rotors 16, 18.

Axial discharge portion 22 is defined by axial porting edges 28, 30 which advantageously define the discharge port for flow from rotors 16, 18 in an axial direction.

In this regard, references to the terms radial and axial are made based upon the radius and axis of rotating rotors within the compressor.

FIG. 1 schematically illustrates radial discharge portion 20 superimposed relative to axial discharge portion 22 for the purpose of illustrating the earlier opening of radial discharge portion 20 in accordance with the present invention. This earlier opening advantageously provides for improved efficiency in operation of the compressor, and further provides for recapture of at least a portion of kinetic energy imparted to the stream by rotors 16, 18.

In accordance with the present invention, it has been found that gas tangential speed is higher near rotor discharge end walls, and gas axial speed is higher near the rotor mesh cusp region inside of the screw compressor flute. Thus, in accordance with the present invention, opening of the radial discharge port earlier than the axial discharge port allows under-compression of radially discharged gas, thereby utilizing kinetic energy generated by higher gas tangential speed in the discharge porting.

Opening of the radial discharge portion prior to the axial discharge portion further allows for a reduction in gas axial resistance, and improves flow of gas axially inside the compressor housing or flute. Thus, in accordance with the present invention, it has been found that opening the tangential or radial discharge portion of the discharge port of the compressor prior to opening of the axial discharge portion of the discharge port of the compressor advantageously provides for capture of at least some kinetic energy imparted to the gaseous stream, thereby enhancing compressor efficiency.

In accordance with the preferred embodiment of the present invention, this preferred opening is provided by positioning of radial porting edges 24, 26 earlier relative to a pitch angle of rotors 16, 18 than axial porting edges 28, 30.

Still referring to FIG. 1, it has further been found in accordance with the present invention that efficiency is improved by opening a portion of the radial portion corresponding to the male rotor earlier than the portion of radial portion 20 corresponding to the female rotor 18. Thus, in accordance with the present invention, male radial porting edge 24 is advantageously positioned earlier relative to the pitch angle of male rotors 16 than female radial porting edge 26 is positioned relative to the pitch angle of female rotor 18.

In accordance with the present invention, the porting as described and illustrated in FIG. 1 is defined by a rotor or stator housing which defines the cylindrical surfaces within which the rotors rotate, and a discharge housing which is positioned axially over the rotor or stator housing, which typically has bearings for the rotors, and which includes the axial porting of the present invention.

Figure 2:
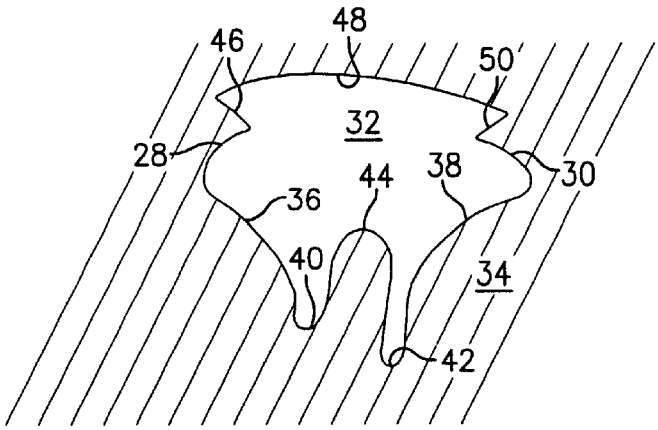
FIG. 2 schematically illustrates the axial porting on a discharge housing portion of a compressor in accordance with the present invention.
Figure 3:
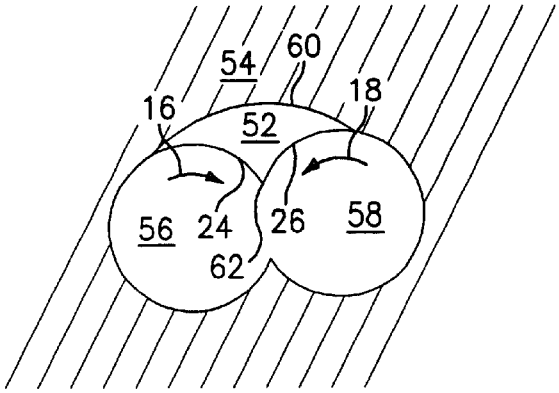
FIG. 3 schematically illustrates a top view of a stator or rotor housing in accordance with the present invention.
Figure 4:
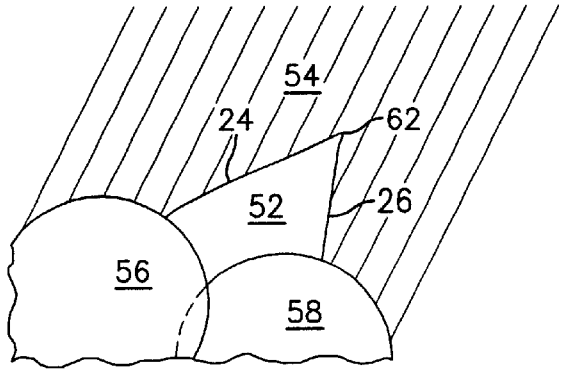
FIG. 4 further schematically illustrates the housing of FIG. 3.
Figure 5A:
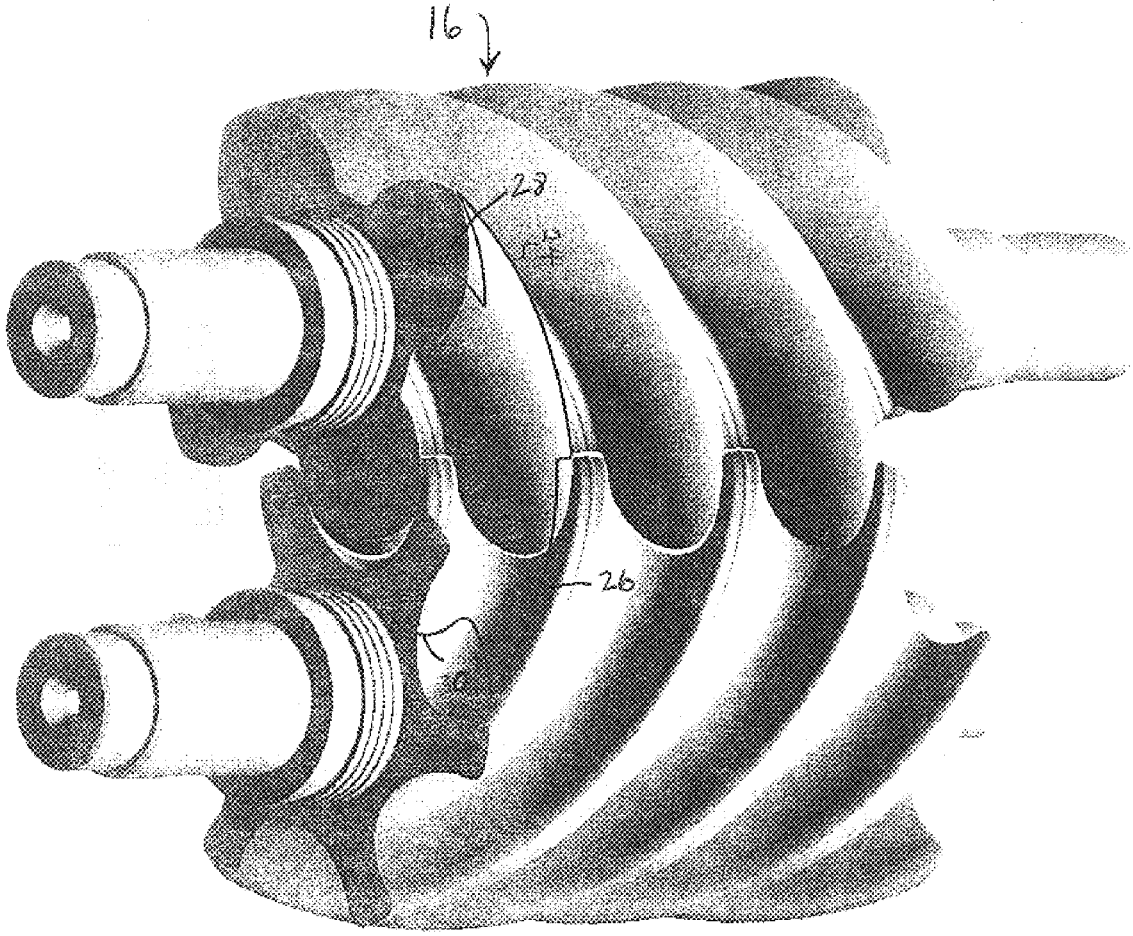
FIGS. 5*a*–5*d* illustrates rotors and the ports of the present invention and show sequential opening in accordance with the present invention.
Figure 5B:
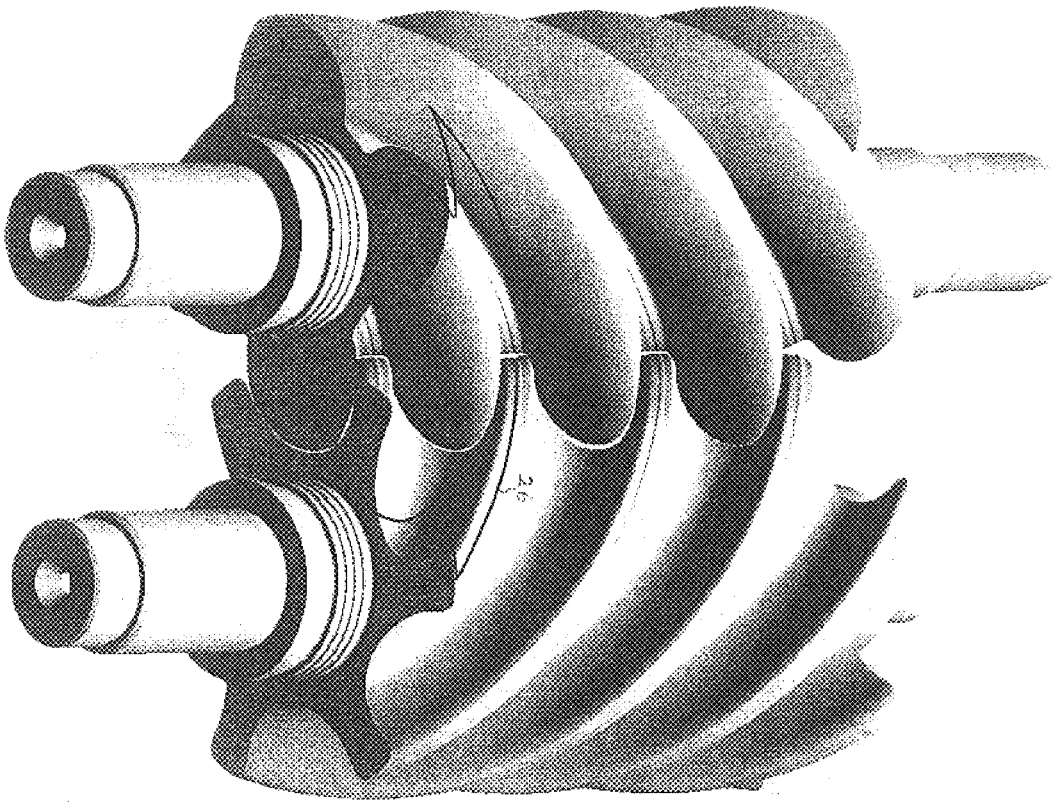
Figure 5C:
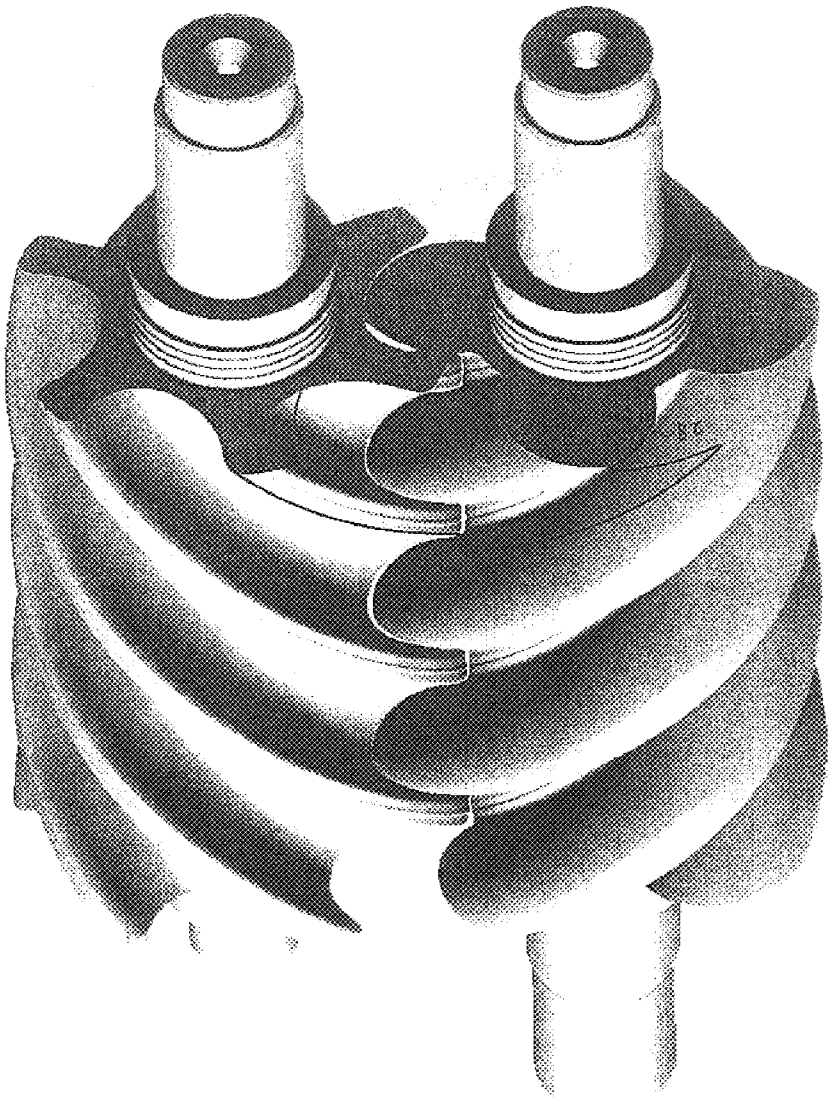
Figure 5D:
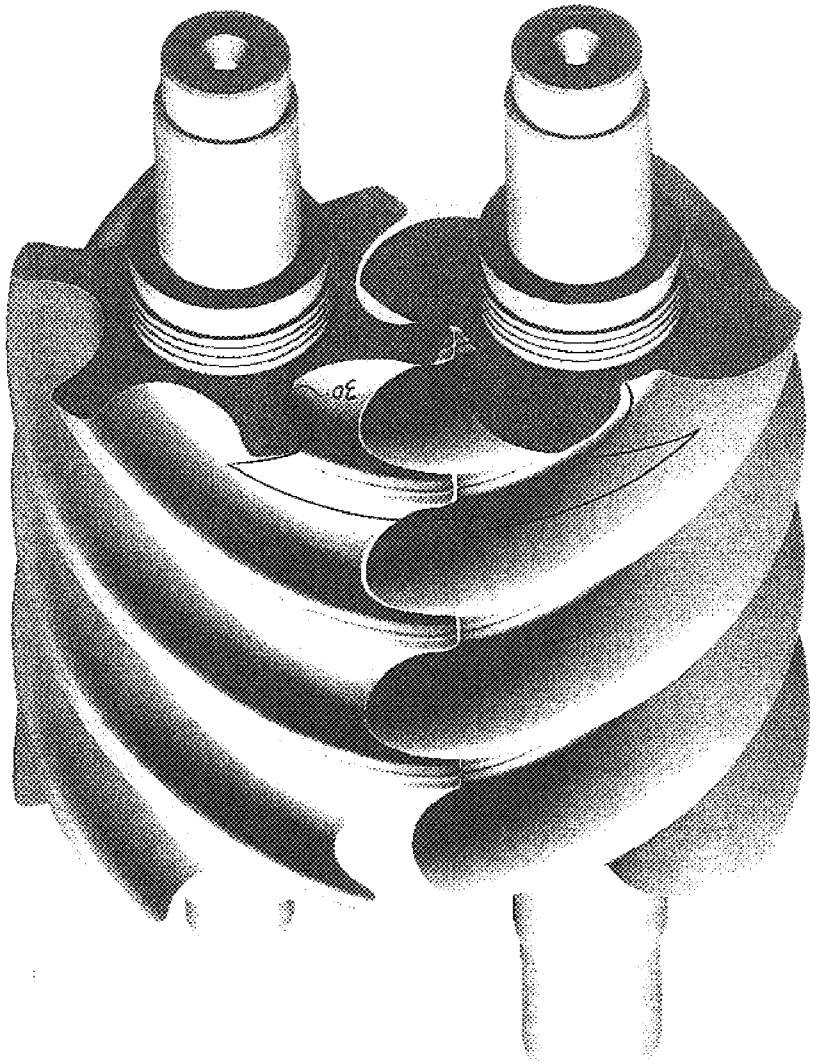
Figure 5A:
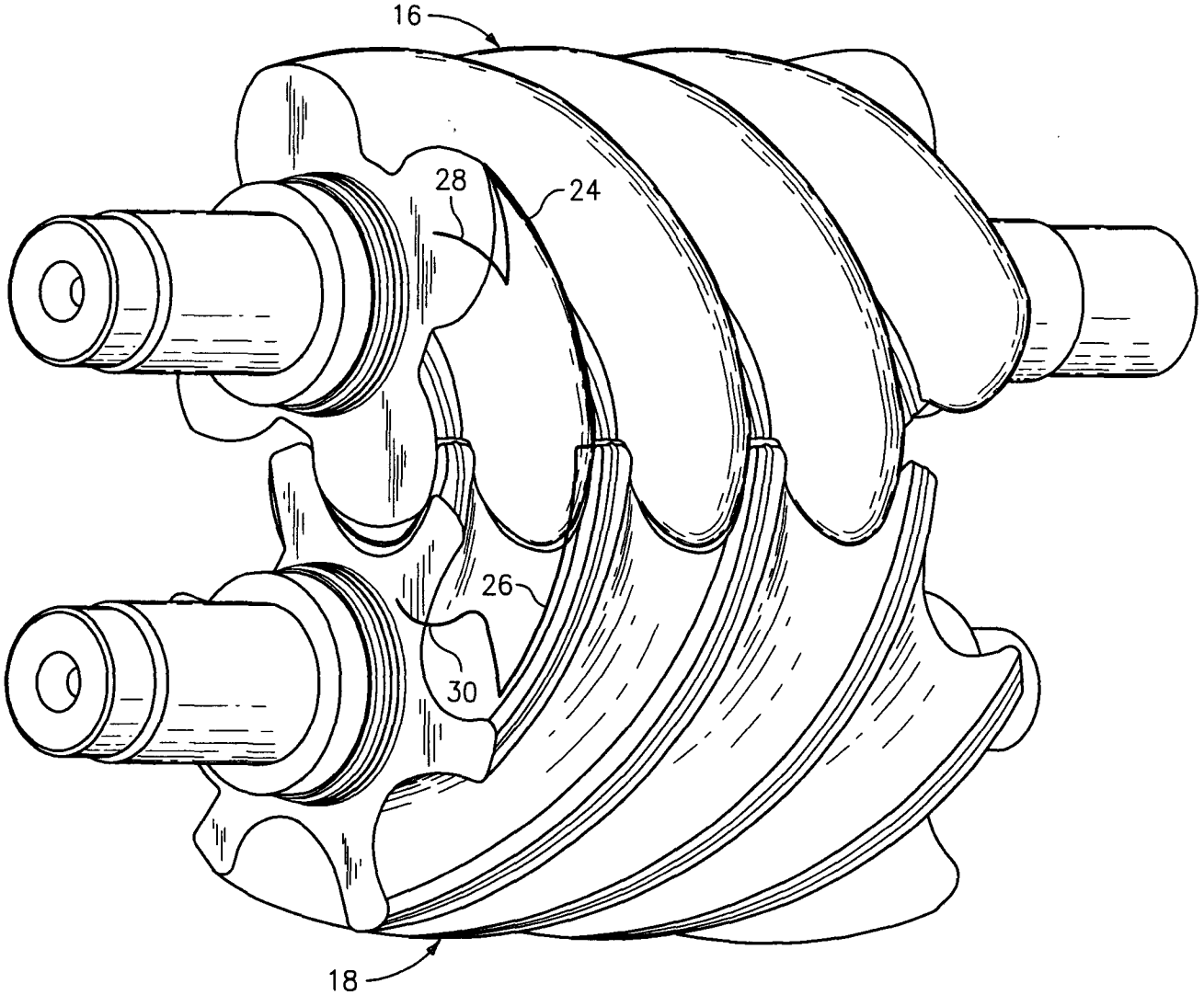
Figure 5B:
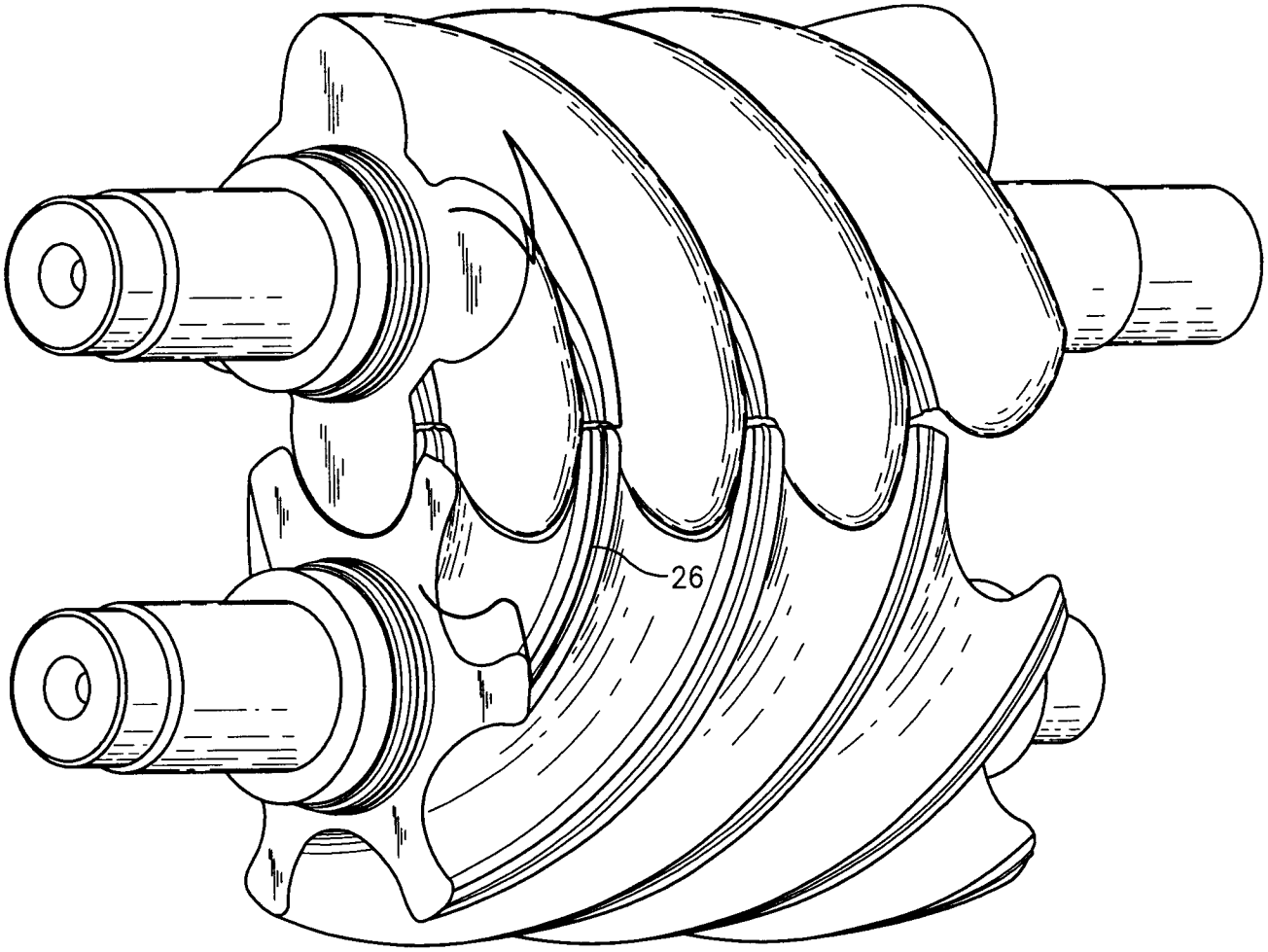
Figure 5C:
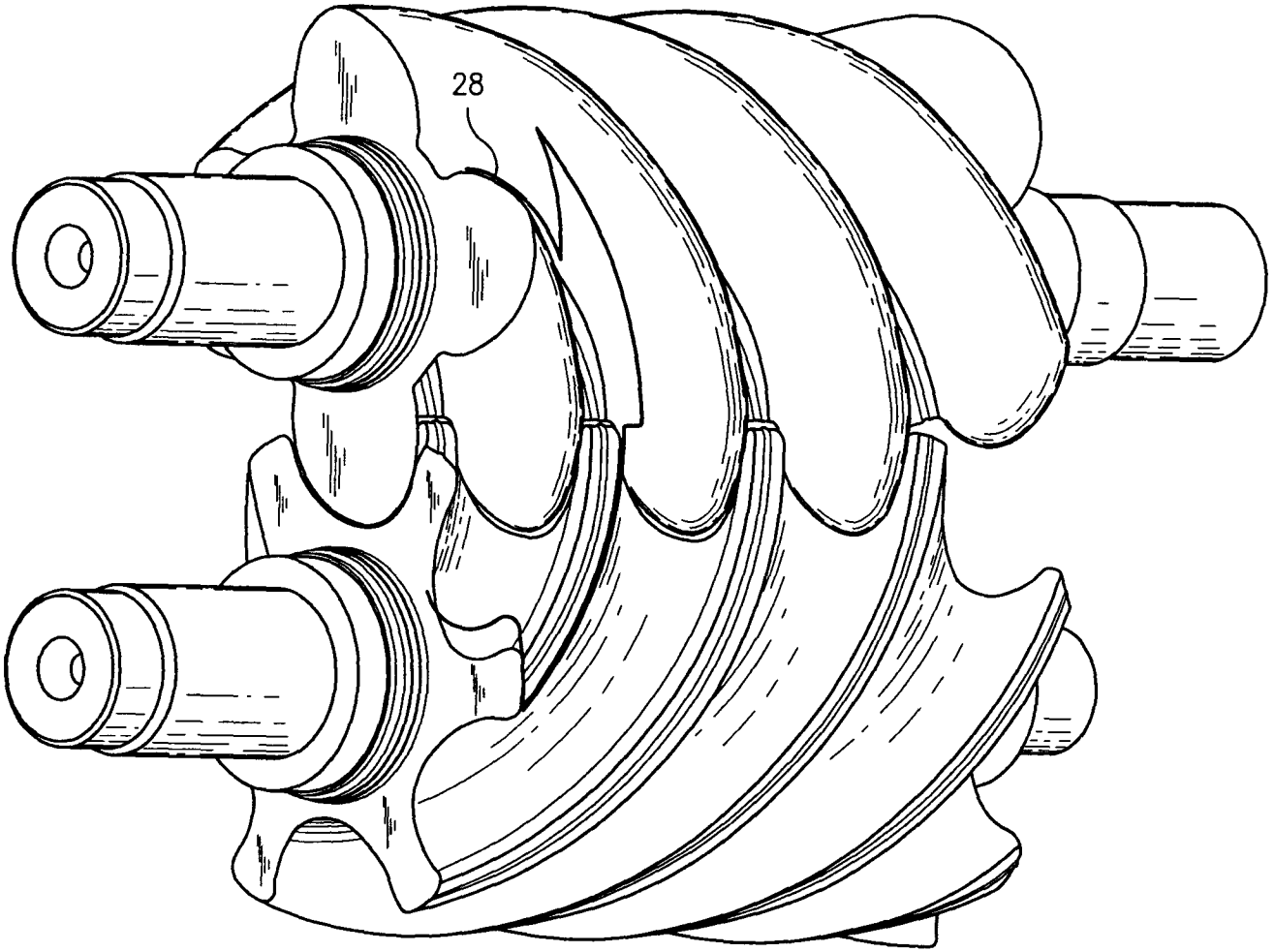
Figure 5D:
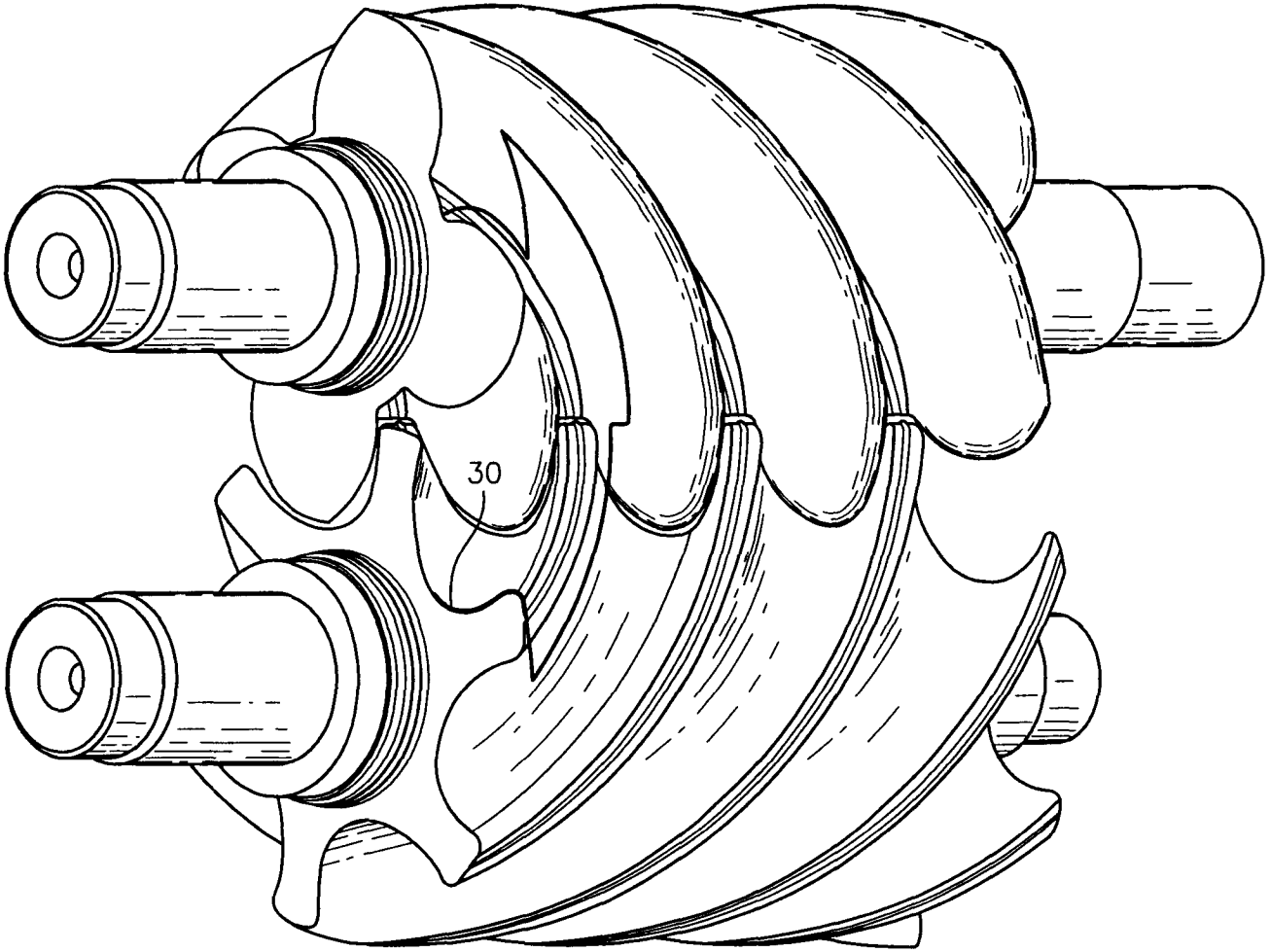

FIGS. 2–4 schematically illustrate this porting from both the discharge housing and stator housing perspectives, with wall portions shown in section so as to further illustrate the contour of the discharge portings in question.

FIG. 2 schematically illustrates the axial portion 32 on the discharge housing, walls 34 of which are schematically illustrated by sectioning around porting 32. Porting 32 is defined by axial porting edges 28, 30, which extend a sufficient distance to allow for axial discharge, and which then curve downwardly along lines 36, 38 to trailing edge portions 40, 42, and then backward to a portion 44 extending in the opposite direction to define the desired contours. Axial discharge porting 32 also includes walls 46, 48, 50 defining a portion which accepts radial flow from radial discharge porting as described in connection with FIG. 1 and as further described in connection with FIGS. 3–4 below.

Turning now to FIG. 3, a schematic illustration of a top view of the stator housing is provided to illustrate radial discharge porting 52 in accordance with the present invention. As shown, schematically illustrated walls 54 define two intermeshed cylindrical spaces 56, 58 within which male and female rotors are rotatably positioned. Radial discharge porting 52 has a top contour 60 defined by an outward edge which preferably meets with edge 48 of discharge housing 34. Radial porting 52 is further defined by radial porting edges 24, 26 which are also illustrated in FIG. 3, and which extend downwardly to point 62 so as to define a substantial V-shape.

FIG. 4 schematically illustrates this structure from a side perspective, to better illustrate the V-shape contour of radial discharge porting 52 in accordance with the present invention. FIG. 4 further shows in an exaggerated fashion the asymmetric or skewed nature of edges 24, 26, which advantageously provide for opening of the male rotor radial porting earlier than the female radial porting as desired.

FIGS. 5*a–d* illustrate rotors 16, 18 and the porting edges in accordance with the present invention and show position of the rotors relative to axial and radial porting edges so as to illustrate the sequential opening of ports as desired in accordance with the present invention.

It should be noted that the discharge housing and stator or rotor housing elements referred to herein may be separate components or may be a single casting or element, well within the scope of the present invention.

Based upon the foregoing, it should be readily apparent that discharge porting for a screw compressor has been provided which advantageously enhances efficiency of discharge flow from the compressor. This is accomplished in accordance with the present invention by providing for earlier opening of radial discharge porting as compared to axial discharge porting, and further by providing for earlier opening of male discharge porting prior to female discharge porting.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor, comprising:

a housing having a discharge port;

a plurality of rotors comprising at least one male rotor and at least one female rotor rotatably disposed in said housing for generating a discharge flow through said discharge port, said discharge port having a radial portion and an axial portion, wherein said discharge port is positioned relative to said plurality of rotors so that said radial portion opens prior to said axial portion, wherein said radial portion has a male radial portion corresponding to said male rotor and a female radial portion corresponding to said female rotor, and wherein said radial portion is positioned relative to said plurality of rotors so that said male radial portion opens prior to said female radial portion whereby kinetic energy in said discharge flow can be recovered.

2. The apparatus of claim 1, wherein said radial portion is defined by radial porting edges and said axial portion is defined by axial porting edges and wherein said radial porting edges are positioned earlier relative to a pitch angle of said plurality of rotors than said axial porting edges whereby said radial portion opens prior to said axial portion.

3. The apparatus of claim 1, wherein said male radial portion is defined by a male radial porting edge and said female radial portion is defined by a female radial porting edge, and wherein said male radial porting edge is positioned earlier along a pitch angle of said male rotor than said female radial porting edge along a pitch angle of said female rotor whereby said male radial portion opens prior to said female radial portion.

4. The apparatus of claim 1, wherein said housing is defined by a rotor housing and a discharge housing, and wherein said radial portion is defined on said rotor housing, and said axial portion is defined on said discharge housing.

5. The apparatus of claim 4, wherein said discharge housing defines said axial portion of said discharge port, and further defines a radial flow portion for receiving flow from said radial portion of said discharge port.

* * * * *

UNITED STATES PATENT AND TRADEMARK OFFICE

CERTIFICATE OF CORRECTION

PATENT NO. : 6,705,849 B2
APPLICATION NO. : 10/201175
DATED : March 16, 2004
INVENTOR(S) : Zhong et al.

It is certified that error appears in the above-identified patent and that said Letters Patent is hereby corrected as shown below:

Replace Figures 5a-5d as shown in the printed patent with Figures 5a-5d as shown in the attached replacement sheets.

Signed and Sealed this

Seventh Day of November, 2006

JON W. DUDAS
*Director of the United States Patent and Trademark Office*